US005404214A

United States Patent [19]

Yoshimoto et al.

[11] Patent Number: 5,404,214

[45] Date of Patent: Apr. 4, 1995

[54] IMAGE HEATING APPARATUS COMPRISING A GROUNDED FILM

[75] Inventors: Toshio Yoshimoto; Nobukazu Adachi, both of Yokohama; Yasumasa Nashida, Kawasaki; Yasuhiro Nakata, Yokohama; Akira Kuroda, Yokohama; Takeshi Sugita, Yokohama; Akira Yuza, Yokohama, all of Japan

[73] Assignee: Canon Kabushiki Kaisha, Tokyo, Japan

[21] Appl. No.: 98,034

[22] Filed: Jul. 28, 1993

[30] Foreign Application Priority Data

Jul. 31, 1992 [JP] Japan ..... 4-205538
Dec. 29, 1992 [JP] Japan ..... 4-361592

[51] Int. Cl.[6] ..... G03G 15/20

[52] U.S. Cl. ..... 355/285; 219/216; 219/469; 355/290; 432/60

[58] Field of Search ..... 355/282, 283, 284, 285, 355/290, 295; 219/216, 469–471; 432/60, 278

[56] References Cited

U.S. PATENT DOCUMENTS

| | | | |
|---|---|---|---|
| 4,801,968 | 1/1989 | Kogure et al. | 219/216 X |
| 4,812,873 | 3/1989 | Inagaki et al. | 219/216 X |
| 4,970,559 | 11/1990 | Miyabayashi | 355/290 |
| 5,083,168 | 1/1992 | Kusaka et al. | 355/285 |
| 5,091,752 | 2/1992 | Okada | 355/285 |
| 5,132,744 | 7/1992 | Maruta et al. | 355/282 |
| 5,148,226 | 9/1992 | Setoriyama et al. | 355/290 |
| 5,149,941 | 9/1992 | Hirabayashi et al. | 219/216 |
| 5,157,446 | 10/1992 | Kusaka | 355/284 |
| 5,196,895 | 3/1993 | Setoriyama et al. | 355/285 |
| 5,262,834 | 11/1993 | Kusaka et al. | 355/285 |

FOREIGN PATENT DOCUMENTS

| | | |
|---|---|---|
| 0469629 | 5/1992 | European Pat. Off. . |
| 60-60670 | 8/1985 | Japan . |
| 64-88483 | 3/1989 | Japan . |

OTHER PUBLICATIONS

European Search Report.

*Primary Examiner*—William J. Royer
*Attorney, Agent, or Firm*—Fitzpatrick, Cella, Harper & Scinto

[57] ABSTRACT

An image heating apparatus includes a heater; a heat transmitting member for transmitting the heat from the heater to an unfixed toner image while moving in contact with a recording material bearing the unfixed image; a pressure roller for forming a nip between the heat transmitting member and itself; wherein the heat transmitting member has a conductive surface; the pressure roller has a conductive core member; and wherein the image heating apparatus further contains a rotating conductive member on the conductive core material in contact with the conductive surface.

12 Claims, 16 Drawing Sheets

IMAGE HEATING APPARATUS COMPRISING A GROUNDED FILM

FIELD OF THE INVENTION AND RELATED ART

The present invention relates to an image heating apparatus for applying the heat from a heater to an image on a recording material, through a thermally conductive member such as a film.

In an image forming apparatus such as an electrophotographic copying machine, printer, or facsimile, an unfixed toner image correspondent to the image data from a target image is formed on a recording material by an image processing means, and this unfixed toner image is thermally fixed by a heating apparatus. As the heating apparatus for thermally fixing the image, a heat roller type apparatus is commonly employed.

The heat roller type apparatus comprises a fixing roller as a heating member and a pressure roller as a pressuring member. The fixing roller is heated by an internal heat source such as a halogen heater, so that it holds a predetermined temperature. The pressure roller is pressed on the fixing roller, with a predetermined pressure, whereby a compression nip (fixing nip) is formed between the two rollers. The recording material is introduced into this nip, where the unfixed toner image is thermally fixed on the surface of the recording material.

In recent years, an image heating apparatus of a through-film heating type has been proposed, for example, in the U.S. Pat. Nos. 5,149,941, 5,262,834, and 5,148,226 and Ser. No. 712,532. This through-film type heating apparatus comprises a heater (heat generating member), a heat resistant film as the heating member, and a pressing member. The heat resistant film is disposed between two rollers and is pressed firmly on the heater by the pressing roller, being thereby driven by the rotation of the pressing roller. There is formed a compression nip (fixing nip) where three components meet, and the recording material is introduced into this fixing nip, between the heat resistant film and pressing member. While the recording material is passed, along with the heat resistant film, through the nip, the heat from the heater is applied through the heat resistant film to the recording material, so that the unfixed toner image is thermally fixed onto the surface of the recording material.

Further, the heating apparatus can be widely used as a means for thermally treating the material to be heated. For example, it can be used as an apparatus for heating the image bearing recording material to modify the surface properties of the recording material (give a glossy texture), an apparatus for temporary fixing the material, or the like.

In this through-film type heating apparatus, a low thermal capacity heater capable of quickly heating up and a thin heat resistant film can be employed. Therefore, there are such practical advantages that electricity consumption can be reduced; a waiting time can be reduced (quick start); an excessive internal temperature increase can be prevented in the main structure of the image forming apparatus; and the like.

As for the heater, a so-called ceramic heater is employed, which has a basic structure comprising a base plate, being heat resistant and insulating, and an exothermic resistor formed on the base plate. The heat is generated by supplying electricity to the resistor.

FIGS. 9 to 13 show examples of the through-film type thermal fixing apparatus, though it is not exactly based on the prior art. FIG. 9 is a schematic sectional view of the fixing apparatus; FIG. 10, a partially cut out perspective view; FIG. 11, a partially cut out plan view of the top surface side of the heater; FIG. 12, a sectional view of a connector coupled with the heater to supply the power; and FIG. 13 is a schematic view of the heat resistant film, showing its laminated structure.

A reference numeral 1 designates a guide member (guide stay member) for guiding the film from inside the film loop. It is shaped like a trough, having a cross-sectional area like a half-moon, and is made of thermosetting resin such as phenol resin. It is disposed perpendicular to the direction in which a recording material P as the material to be heated is delivered. On the downward facing surface of this guide member 1, a heat resistant, insulating heater holder is affixed, extending in the longitudinal direction of the guide member 1. The heater 3 is tightly held by the heater holder 2, and generates heat as it receives the power.

A reference numeral 4 designates a tube-like heat resistant film (fixing film) fitted loosely around the film guide member 1 which braces the heater 3, and a reference numeral 5 designates a pressure roller as the pressing means, being pressed against the heater 3, with the film 4 being sandwiched between the two.

Referring to FIG. 10, a reference numeral 6 designates an apparatus chassis made of metallic plate. Reference numerals 7 designate bearings made of insulating material, and they support the pressure roller 5, at each of the metallic cores 5*a* of the pressure roller 5. Reference numerals 8 designate springs being disposed at each longitudinal end of the film guide member 1 in order to impart a predetermined pressure onto the upper surface of each of the extended end pieces of the film guide member 1.

Referring to FIG. 9, a reference code N designates the compression nip (fixing nip) formed by the heater 3 and pressure roller 5 as the latter is pressed upon the former, with the film sandwiched between the two.

Referring to FIG. 11, the heater 3 is a ceramic heater having a small overall thermal capacity, comprising basically a ceramic base plate 31 and an exothermic resistor 32. The ceramic base plate 31 is made of alumina or the like, which is insulating, highly heat resistant, and of a low thermal capacity. The exothermic resistor 32 is made of silver palladium or the like, and is formed on the top surface (surface on which the film slides) of the base plate 31, through the process of printing and baking, in the shape of a wire or narrow band extending in the longitudinal direction of the base plate 31.

Reference numerals 33 designate electrodes made of Ag or the like. They are formed by patterning, on the base plate, at each end of the exothermic resistor 32, and are electrically connected to the exothermic resistor 32. The base plate is covered with a thin surface protection layer 34 made of glass, fluororesin, or the like, on the top surface side containing the exothermic resistor 32, and is provided with a temperature detecting element 35 (temperature sensor such as a thermistor), an overheat preventing means 36 (component to prevent overheating, for example, a thermal fuse), or the like, on the back side surface.

Referring to FIG. 12, reference numerals 9 designate power supply connectors engaged with the heater holder 2 which braces the heater 3, at each end of the heater. Both of them comprise a contact 9*a* and a contact case 9*b*. The contact 9*a* is formed as a metallic plate spring, and establishes electrical connection for the heater 3 as it comes in contact with the above described electrode 33 of the heater, and the contact case 9*b* is formed of resin and covers the periphery of the contact 9*a*.

As soon as the AC power is supplied between the electrodes 33 of the heater 3, from a power source (unshown) through the connectors 9, the exothermic resistor 32 generates heat, quickly increasing the temperature of the entire heater. The increasing temperature is detected by the temperature detecting element 35, and the obtained temperature data are used by a power supply control system (unshown) to control the amount of power supply to the exothermic resistor 32, whereby the temperature of the heater 3 is maintained at a predetermined one.

The film 4 is heat resistant, is excellent in toner-parting characteristics, and has a high tensile strength. In order to shorten the waiting time at the startup by reducing the thermal capacity, the film thickness is preferred to be no more than 100 μm, more preferably, no more than 50 μm and no less than 20 μm.

FIG. 13 shows the laminated structure of the film 4. As shown in the drawing, the film 4 has three layers: approximately 50 μm thick polyimide resin layer 4*a* as an innermost layer, approximately 5 μm thick conductive primer layer 4*b* as a middle layer, and approximately 10 μm thick fluororesin layer 4*c* as an outermost layer. The resistance value per unit area of the conductive primer layer 4*b* is no more than $10^8$ Ω/□.

The pressure roller 5 comprises a metallic central core 5*a*, a heat resistant silicone rubber roller layer 5*b* formed concentrically on the metallic core 52, and a fluororesin coat covering the surface of the roller layer 5*b*.

Referring to FIG. 10, the pressure roller 5 is provided with a gear 5*c* fixed at one end of the axis. This gear 5*c* is engaged with a gear (unshown) of the drive train of the main structure of the image forming apparatus, whereby the pressure roller 5 is rotated at a predetermined peripheral velocity. As the pressure roller 5 is rotated, the tube-like film 4 is driven by the surface friction from the pressure roller 5, around the film guiding member 1, while being tightly pressed upon and sliding on the surface of the heater 3.

Referring to FIG. 9, while the film 4 is driven around the guiding member 1 by the rotation of the pressure roller 5, and the heater 3 is generating heat, the recording material P bearing the unfixed toner image on the upper surface is delivered, as the material to be heated, from the unshown image processing means, and is introduced by an entrance guide 10 into the fixing nip N, between the rotating film 4 and rotating pressure roller 5.

The recording material P introduced into the fixing nip N is passed through the fixing nip N, along with the rotating film 4, while being tightly pressed on the surface of the rotating film 4. Meanwhile, the thermal energy from the heater 3 is applied to the recording material P through the film 4 to fix thermally the toner image. The recording material P passed through the fixing nip N is guided by a discharging guide 11 to be discharged into a specified tray (unshown).

The heat resistant film 4 as the material to be heated and the pressure roller 5 as the pressing member are grounded by the electrical connection. This is for preventing the deterioration of the unfixed toner image on the recording material P caused by an electrostatically charged heat resistant film 4 or pressure roller 5, and also, for preventing an apparatus malfunction caused by the noise generated as the accumulated charge leaks to the ground.

In the apparatus described above, the heat resistant film 4 as the heating member is not provided with the fluororesin coating layer 4*c* as the outermost layer, at one of the lateral ends and outside the passageway of the material to be heated, exposing thereby the conductive primer layer 4*b*, that is, the middle layer (FIG. 13). The accumulated charge is discharged to ground by means of placing a charge removing brush 13 (FIG. 10) in contact with the surface of this exposed primer layer 4*b*. As for the pressure roller 5 as the pressing member, its charge is discharged to ground by means of placing a carbon contact 14 in contact with the metallic core 5*a* of the pressure roller 5, using the spring force from a metallic leaf spring 21.

However, the charge removing brush 13 was easily deformed by the heat or external pressure, and when it was deformed, it failed to maintain good electrical connection with the heating member or the pressing member which comes in contact with the brush, and became liable to cause image deterioration or apparatus malfunction during the image forming operation.

Further, in case the heating member was the film 4, the film surface was damaged as it was scrubbed by the charge removing brush 13, which was liable to cause a connection failure. Also, in case the carbon contact was used in place of the charge removing brush 13, the scrubbed surface was damaged, and therefore, there were such troubles as an inferior electrical connection or strange sounds coming out of the contact point.

SUMMARY OF THE INVENTION

Accordingly, a principle object of the present invention is to provide an image heating apparatus in which the heating film can remain reliably grounded.

According to an aspect of the present invention, a conductive member which comes in contact with the heating film is provided on the metallic core of a pressure roller which forms a nip in which the heating film is sandwiched.

According to another aspect of the present invention, the heating film is grounded through a resistor.

The other aspects of the present invention will become more apparent upon consideration of the following descriptions of the preferred embodiments of the present invention, along with the accompanying drawings.

DESCRIPTION OF THE PREFERRED EMBODIMENTS

Figure 1:
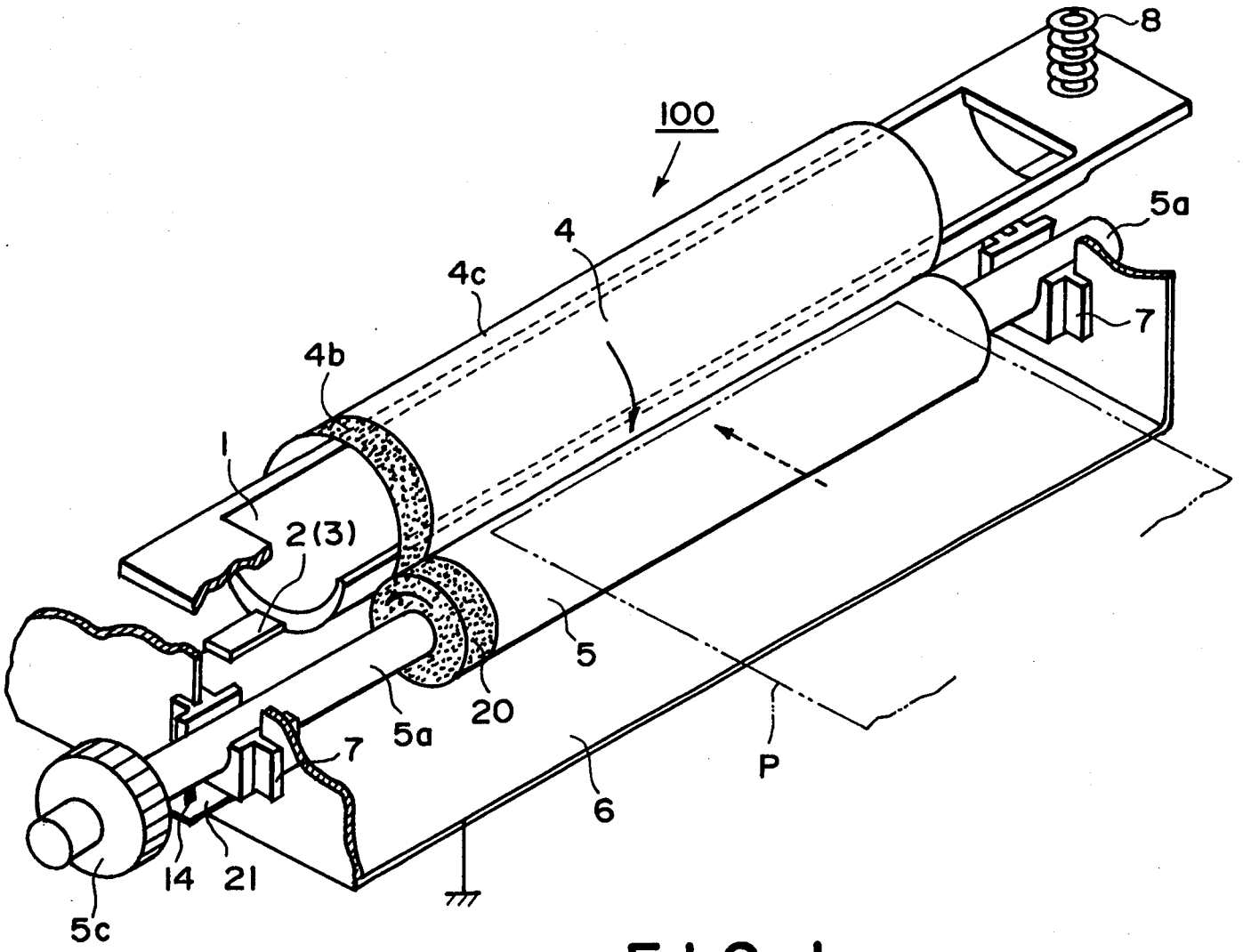
FIG. 1 is a perspective view of a preferred embodiment of the image heating apparatus in accordance with the present invention.
Figure 2:
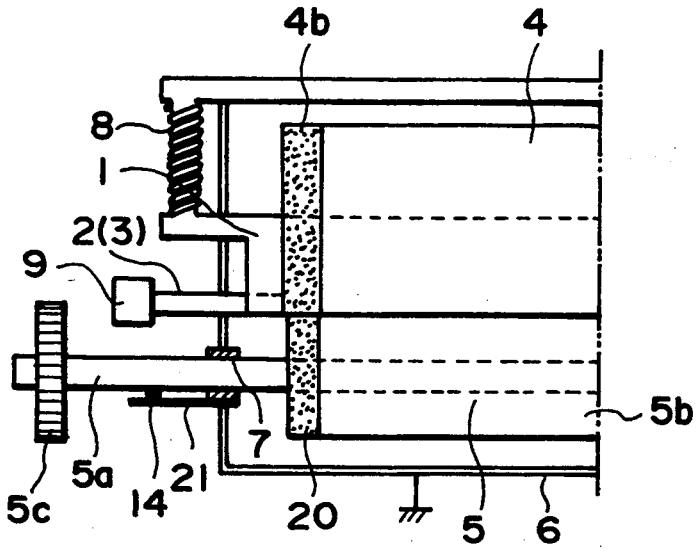
FIG. 2 is a partial sectional view of a embodiment shown in FIG. 1.

Hereinafter, the preferred embodiment of the present invention is described referring to the drawings.

In FIGS. 9 to 13, the same members are designated by the same reference codes, and the repetition of the descriptions is avoided.

FIG. 1 is a perspective view of a preferred embodiment of the image heating apparatus in accordance with the present invention.

A reference numeral 5 designates a pressure roller comprising an electrically insulating silicone rubber roller, around which a tube of an electrically insulating fluororesin film is loosely fitted.

A reference numeral 20 designates a conductive member which is composed of conductive sponge material (conductive sponge rubber) and is shaped like a doughnut. The conductive member 20 is fitted on a metallic core 5*a* projecting from one end of the pressure roller 5, and is tightly placed on the lateral surface of the rubber layer 5*b*, where it remains in contact with an exposed conductive primer layer 4*b*, as a conductive surface, of the tube-shaped heat resistant film 4, as the heating member. The external diameter of the conductive member 20 is substantially the same as the rubber roller layer 5*b* of the pressure roller 5, and its hardness is chosen to be substantially the same as, or slightly less than, that of the rubber roller layer 5*b* of the pressure roller 5. Further, the conductive member 20 rotates together with the pressure roller 5 while remaining in contact with the exposed conductive primer layer 4*b*. As for the surface layer having a parting property, it is composed of insulating fluororesin.

The volumetric resistance of the conductive sponge member 20 is regulated to be no more than $10^8\ \Omega/cm$ by controlling the amount of carbon black to be mixed in the silicone foam rubber.

A reference numeral 14 designates a carbon contact. It is mounted on a metallic leaf spring 21, remaining thereby in contact with the metallic core 5*a* of the pressure roller 5, with a predetermined pressure. The metallic leaf spring 21 is fixed on the side plate of an apparatus chassis 6, being grounded thereby through the apparatus chassis 6.

Therefore, the heat resistant film 4 as the heating member is grounded through the exposed conductive primer layer 4*b* as the conductive surface→conductive sponge member 20 as the conductive member of the pressure roller 5→metallic core 5*a* of the pressure roller 5→carbon contact 14→leaf spring 21→and metallic plate apparatus chassis 6, in this order. Also, the pressure roller 5 as the pressing member is grounded through the metallic core 5*a*→carbon contact 14→leaf spring 21→and apparatus chassis 6.

The conductive sponge member 20 rotates together with the pressure roller 5 while remaining in touch with the conductive surface 4*b* of the rotating heat resistant film 4. Since the external diameter of the conductive sponge member 20 is substantially the same as the rubber roller layer 5*b*, the travelling speed of the heat resistant film 4 is substantially the same as the peripheral speed of the conductive sponge member 20.

The conductive sponge member 20 is located beyond the passageway of the recording material, and therefore, even while the recording material is passed, the conductive sponge member 20, and the conductive surface 4*b* constituting the lateral end surface of the heat resistant film 4 always remain in contact with each other, maintaining thereby electrical connection.

Thus, according to this embodiment, it is possible to reliably keep the heating film grounded over a long service life of the apparatus.

Embodiment 2

In the case of the embodiment discussed above, the conductive member 20 is made of conductive sponge material (sponge rubber). However, it may be made of conductive solid rubber (silicone rubber, fluorocarbon rubber) as long as it is flexible and conductive. Further, a discharge brush may be used as the conductive member 20 as long as it is flexible.

Figure 3:
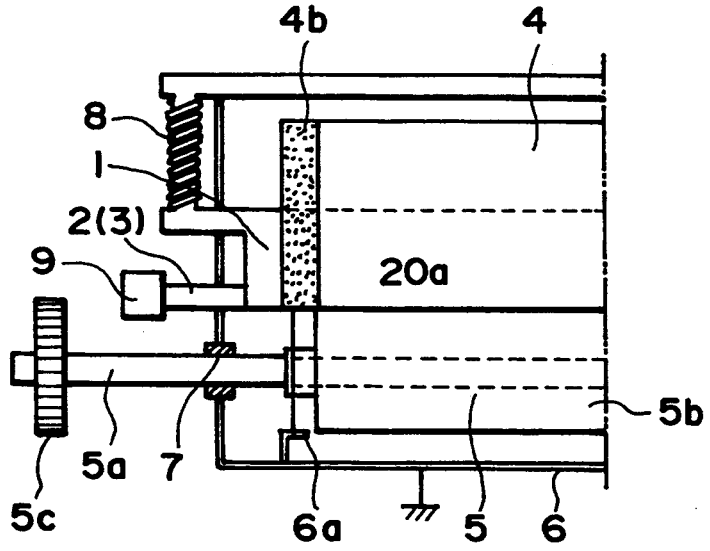
FIG. 3 is a partial sectional view of the second embodiment of the present invention.

FIG. 3 shows another embodiment in which a disk-shaped discharge brush 20*a* is adopted as the conductive member. The discharge brush 20*a* is fitted on the metallic core 53 of the pressure roller 5, being electrically connected thereto, and is rotated together with the pressure roller 5. The external diameter of the disk-shaped discharge brush 20 is substantially the same as that of the rubber roller layer 5*b* of the pressure roller 5, so that reliable electrical connection is always maintained between the disk-shaped discharge brush 20*a* and the conductive surface 4*b* of the heat resistant film 4.

Further, this disk-shaped discharge brush 20*a* is placed in contact with a portion 6*a* of the apparatus chassis 6. Therefore, the heat resistant film 4 as the heating member is grounded through the conductive surface 4*b*→disk-shaped discharge brush 20*a*→the portion 6*a* of the apparatus chassis 6→and apparatus chassis 6, and the pressure roller 5 as the pressing member is grounded through the metallic core 5a→disk-shaped discharge brush 20a→portion 6a of the apparatus chassis→and apparatus chassis 6.

In the structure of this embodiment, the carbon contact 4 and leaf spring 21 required in the first embodiment are unnecessary.

Even in the first embodiment, the carbon contact 14 and leaf spring 21 can be eliminated if the conductive sponge member 20 is made to contact with the portion 6a of the apparatus chassis 6 in the same manner as the disk-shaped discharge brush 20 of this embodiment is.

Embodiment 3

Figure 4:
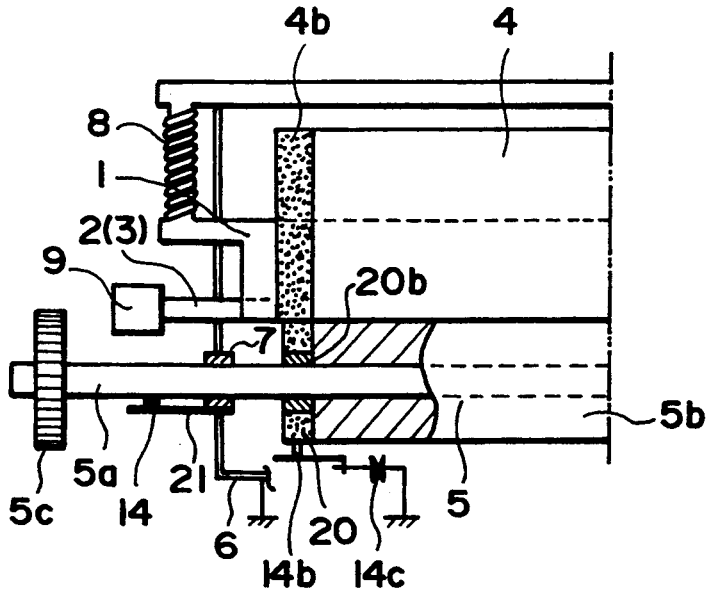
FIG. 4 is a partial sectional view of the third embodiment of the present invention.

FIG. 4 is a sectional view of the third embodiment of the present invention.

In this embodiment, the conductive sponge member 20 as the conductive member is fitted on the metallic core 5a of the pressure roller 5, with interposition of an insulating member 20b, and is grounded through a conductive contact member 14b being placed in contact with this conductive sponge member 20, and through a diode 14c.

In other words, the heat resistant film 4 as the heating member is grounded through conductive surface 4b→the conductive sponge member 20→conductive contact member 14b→and diode 14c, and the pressure roller 5 is grounded through the metallic core 5a of the pressure roller 5→carbon contact 14→leaf spring 21→and apparatus chassis 6.

In the above described embodiments 1 to 3, contact surface 4b of the heat resistant film 4 may cover the entire width, instead of covering just one lateral end of the film. Also, the rubber roller layer 5b of the pressure roller 5 may be made of conductive material.

Embodiment 4

Figure 5:
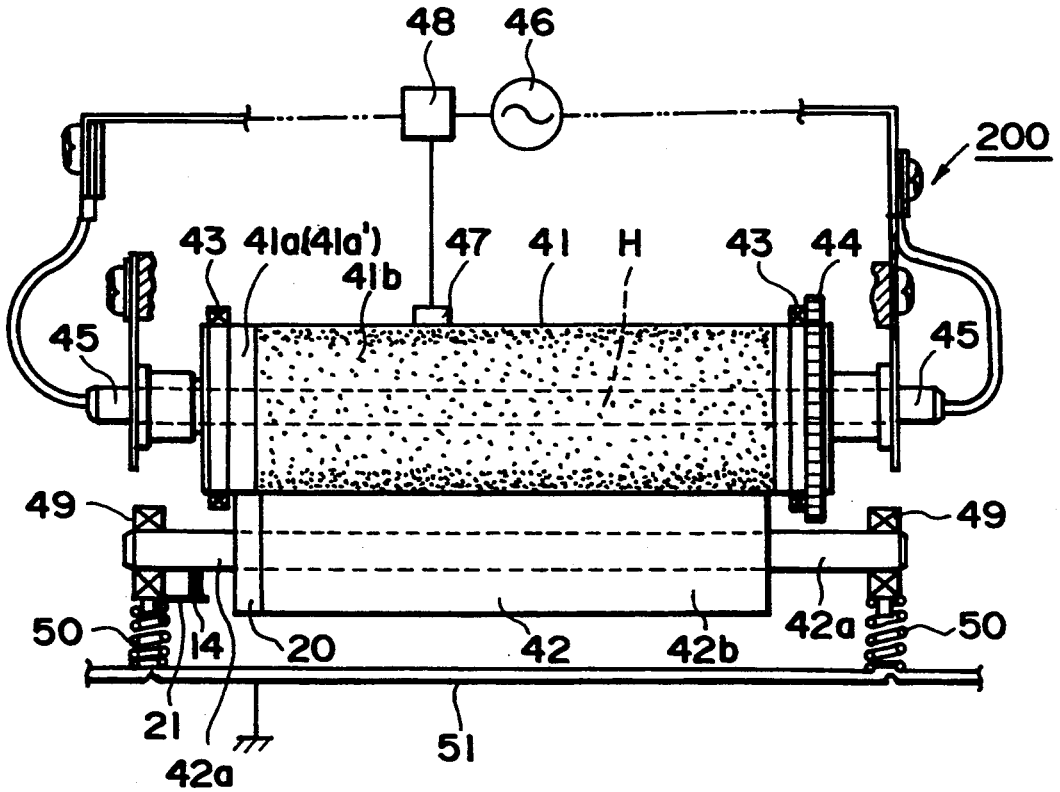
FIG. 5 is a front view of the fourth embodiment of the present invention.

FIG. 5 shows the fourth embodiment of the present invention. This embodiment refers to a case in which the present invention is applied to a heating apparatus 200 (image fixing thermal apparatus) of a heat roller type.

A reference numeral 41 designates a fixing roller as the heating member with a built-in halogen heater. It comprises a hollow aluminum roller 41a and a coating layer 41b of polytetrafluoroethylene resin (Teflon) covering the peripheral surface of the cylinder.

This fixing roller 41 is supported at both ends by a bearing 43 so as to be freely rotated. At one end of the fixing roller 41, a fixing roller gear 44 is attached, through which a driving force is transmitted from a gear of an unshown driving mechanism to rotate the fixing roller 41 at a predetermined peripheral velocity.

A reference numeral 45 designates a power supply connector coupled with the halogen heater H at each end, through which the power is supplied from an AC power source 46 to the halogen heater H, whereby the fixing roller 41 is heated by the heat from the halogen heater H. The temperature of the fixing roller 41 is detected by a temperature sensor 47. The obtained temperature data is inputted to a power supply control circuit 48 to be used for controlling the power supply to the heater H, to maintain the temperature of the fixing roller 41 at a predetermined one.

Reference numeral 42 designates a pressure roller as the pressing member. Its metallic core 42a is supported at both ends by bearings 49 which are allowed to move freely in the vertical direction while allowing free rotation of the pressure roller. The bearings 49 are pressed upward by pressure springs 50 interposed compressively between the bearings 49 and the apparatus chassis 51, whereby rubber roller layer 42b of pressure roller 42 remains in contact with the fixing roller 41 with a predetermined contact pressure. The pressure roller 42 is rotated by the rotation of the fixing roller 41.

As the two rollers rotate, a recording material is introduced into and conveyed through a pressure nip (fixing nip) formed between the fixing roller 41 and pressure roller 42, where unfixed toner images on the recording material are thermally fixed.

The coating layer 41b is not provided over one lateral end of the peripheral surface of the fixing roller 41, in other words, the exposed surface 41a of the aluminum roller 41a is made to serve as a conductive surface 41a'.

A reference numeral 20 designates a conductive sponge member as the conductive member like the one fitted on the metallic core 5a of the pressure roller 5 in the first embodiment. It rotates together with the pressure roller 42 while remaining in contact with the conductive surface 41a' of the fixing roller 41.

A reference numeral 14 is a carbon contact, which is mounted on a leaf spring 21 so that it remains in contact with metallic core 42a of the pressure roller 42, with a predetermined contact pressure generated by the resilient force of leaf spring 21. The leaf spring 21 is electrically connected to an apparatus chassis 51 of metal plate, through pressure spring 50.

The fixing roller 41 as the heating member is grounded through conductive surface 41a'→conductive sponge member 20 as the conductive member belonging to the pressure roller 42, that is, the pressing member metallic core 42a of the pressure roller 42→carbon contact 14→leaf spring 21→conductive pressure spring 50→and apparatus chassis 51. The pressure roller 42 as the pressing member is grounded through metallic core 42a→carbon contact 14→leaf spring 21→conductive pressure spring 50→and apparatus chassis 51.

Hereinafter, preferred methods for supplying power in the embodiments 1 to 3 are described.

Figure 6:
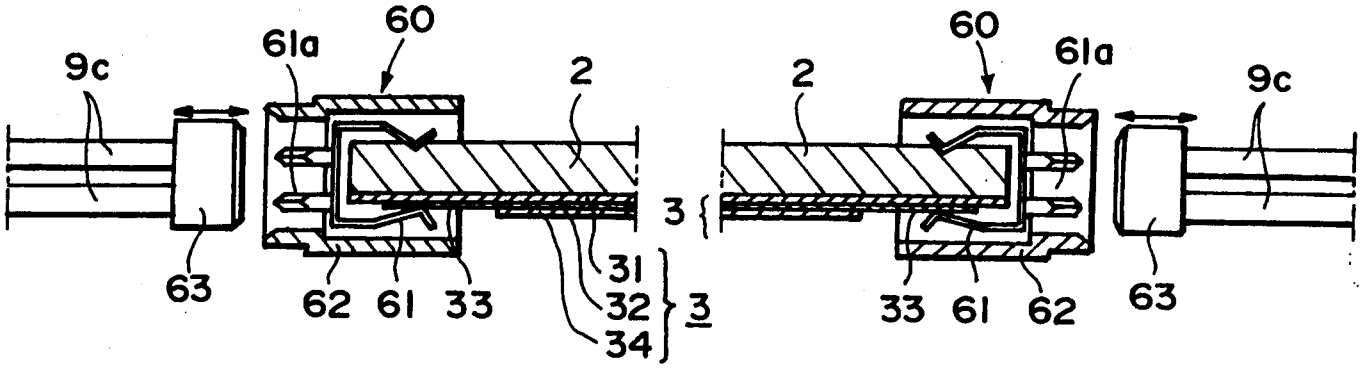
FIGS. 6 and 7 are sectional views of connectors.

FIG. 6 is a sectional view of power supply connectors.

A heater 3 is tightly fixed to a heater holder 2. The power supply connector 60 is plugged in with the heater 3 (including heater holder) at each end, wherein a contact member 61 of the power supply connector 60 contacts an electrode 33 of the heater 3.

One end of the contact member 61 of the power supply connector 60 is plugged in with the heater electrode 33 and heater holder 2 in a manner so as to squeeze them with a predetermined pressure (for example, approximately 200 g). The other end of the contact member 61a is shaped so as to be plugged into a universal connecter 63, connected to lines 9c to the power source. Therefore, the heater 3 can be separated from the apparatus, at the universal connector 63, instead of at the connection between the heater 3 (including the heater holder 2) and the contact member 61. A reference numeral 62 designates a contact case. Having the above described structure, this embodiment has the following effects.

1. Since the contact member 61 does not depend on the contact case 62 to remain plugged in with the heater electrode 33 and heater holder 2, in other words, since it does not depend on the contact case 62 to maintain the electrical contact, the electrical connection is not affected by the deformation of the contact case 62 which may be caused by the heat from the heater 3.

Therefore, the electrical connection, which was once dependent on the unit accuracy, attachment accuracy, and heat resistance of the contact case, can be reliably obtained. Further, since the reactive force from the contact pressure is not imparted to the contact case, it is not necessary for the contact case material to have a thermal deformation point as high as the one conventionally required, in other words, inexpensive material can be used, offering a cost reducing effect.

2. The titanium-copper alloy used for the contact member 61 in this embodiment is excellent for relieving the thermal stress, and therefore, the contact member 61 of this embodiment can maintain a predetermined contact pressure over a much longer period, while being in contact with the heater maintained at a high temperature, than can the contact member made of other metallic material (for example, phosphor-bronze alloy), which in turn prolongs the service life of the heating apparatus itself.

3. The universal connector 61 connected to the power source can be easily plugged in or unplugged because of the shape of the other end 61*a* of the contact member 61. In other words, when the heater 3 (including the heater holder 2) is needed to be mounted in or removed from the heating apparatus, the contact member 61 is not plugged in with or unplugged from the heater 3, and therefore, such chances are reduced to a minimum, that the heater electrode 33 formed of thin film is peeled off by plugging in or unplugging the contact member 61.

Figure 7:
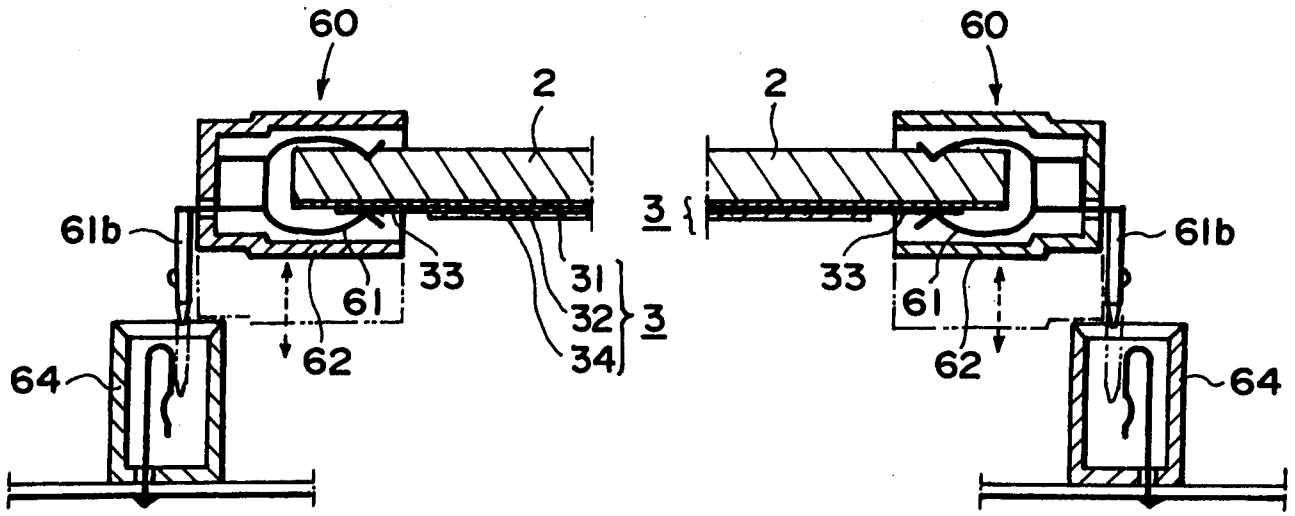

Next, another power supplying method is described referring to FIG. 7.

In this embodiment also, one end of the contact member 61 makes electrical contact with the heater holder 2 and the heater electrode 33 by clasping onto them with a predetermined pressure, and the reactive force from the contact member 61 is not imparted to the contact case 62 at all. However, the other end 61*b* of the contact member 61 is shaped so as to be directly plugged into a socket 64 on the power supply side as shown in FIG. 7. In other words, the socket 64 of the power supply side and the contact member 61 on the heater side make direct electrical contact with each other, eliminating a need for connectors and lead wires between the two components. Therefore, the cost can be reduced while improving the assembly quality. In addition, the stress imparted on the contact material by the wiring the lead wire is eliminated, improving thereby the reliability of the electrical connection.

Figure 8:
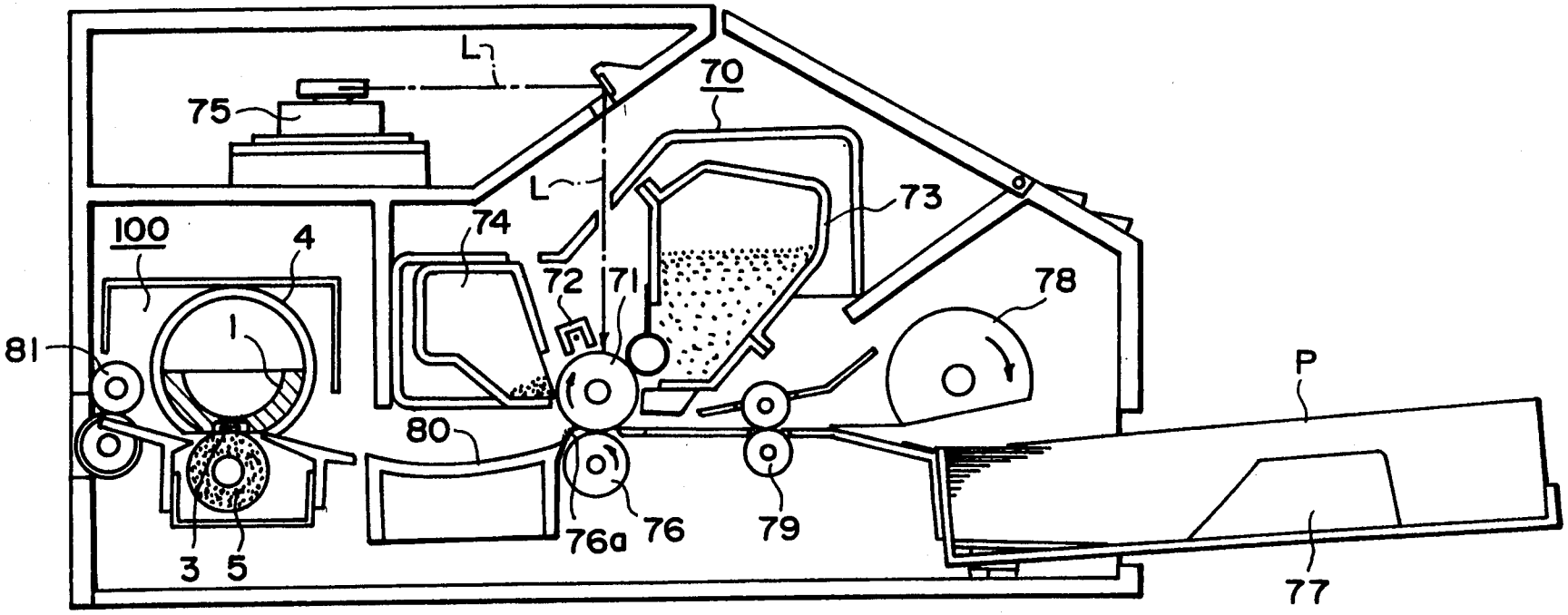
FIG. 8 is a sectional view of an image forming apparatus incorporating the embodiment of the present invention.
Figure 9:
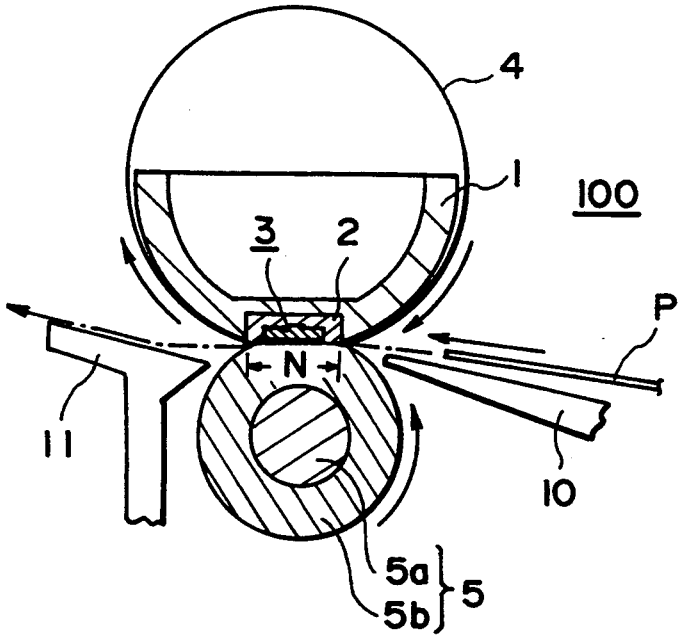
FIG. 9 is a sectional view of an example of image heating apparatus of a through-film type heating type.
Figure 10:
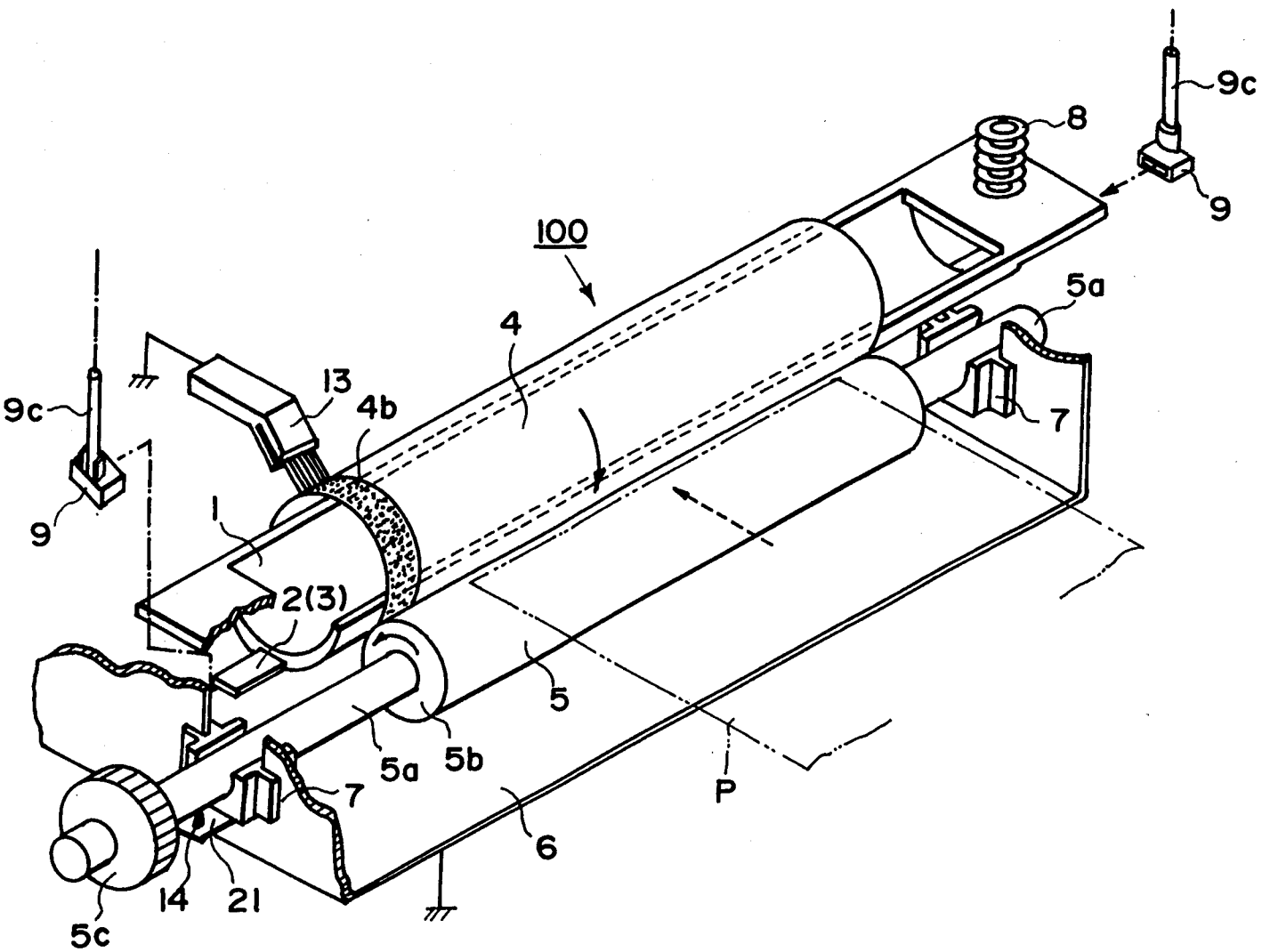
FIG. 10 is a perspective view of the example of image heating apparatus shown in FIG. 9.
Figure 11:
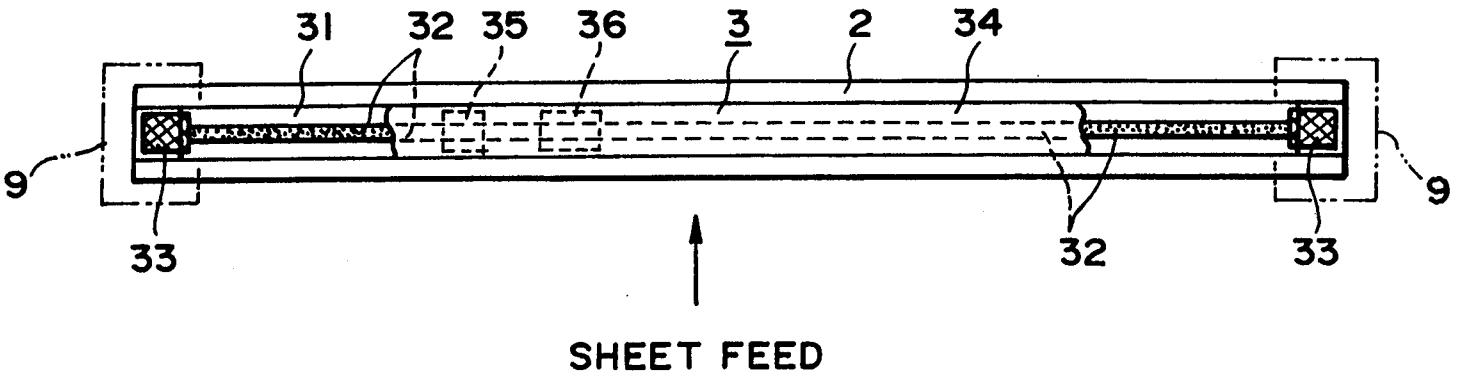
FIG. 11 is a sectional view of the heater incorporated in the example of image heating apparatus shown in FIG. 9.
Figure 12:
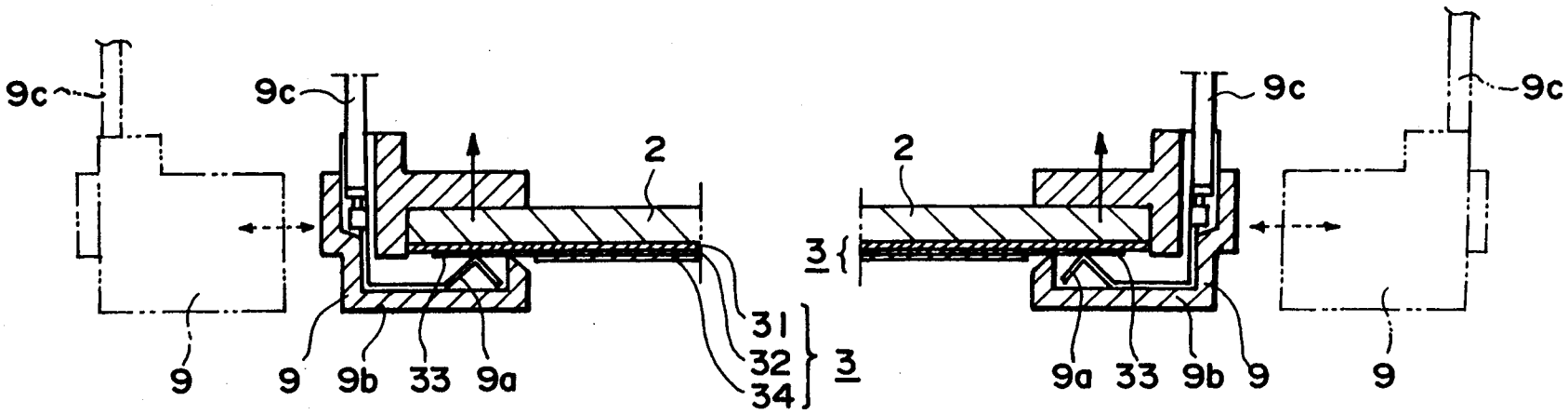
FIG. 12 is a sectional view of connectors incorporated in the example of image heating apparatus shown in FIG. 9.
Figure 13:
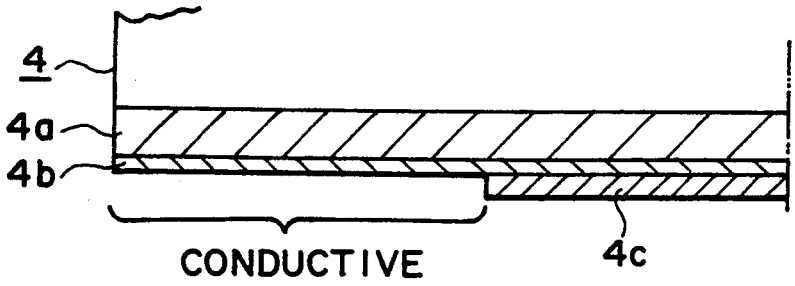
FIG. 13 is a sectional drawing depicting a laminated film structure.

FIG. 8 is a sectional view of an image forming apparatus incorporating an embodiment of image heating apparatus of the through-film type heating system in accordance with the present invention.

A reference numeral 70 designates a process cartridge, comprising an electrophotographically sensitive member of a rotational drum 71 (hereinafter, referred to as a drum), primary charger 72, developing apparatus 73, cleaning apparatus 74, and the like. The drum 71 is rotated at a predetermined peripheral velocity in the clockwise direction indicated by an arrow. While being rotated, it is uniformly charged to a predetermined potential of the negative polarity, and then, is exposed to the scanning laser beam L from a laser scanner 75, in other words, image data of a target image are written on the drum, whereby an electrostatic latent image is formed on the peripheral surface of the drum in response to the image data.

Next, the latent image is developed into a visual toner image by the developing apparatus 73. Meanwhile, a recording material P (transfer material) is delivered from a sheet feeder cassette 77 to a transfer station formed between the transfer roller 76 and drum 71, in synchronization with this toner image, by a feed roller 78 and register roller 79. As the toner image passes across a transfer roller 76, it is serially transferred onto the recording material P. Here, the toner image is transferred from the drum 71 onto the recording surface of the recording material P as the other side of the recording material P is charged by the transfer roller 76 to the polarity opposite to the toner image polarity.

Coming out of the transfer station, the recording material P is cleared of the charge by a discharging needle 76*a* imparted with a voltage having the polarity opposite to the one imparted to the transfer roller 76, being thereby separated from the drum 71. Then, it is conveyed through a passageway 80 to be introduced into an image fixing thermal apparatus 100, where the toner image is thermally fixed as a permanent image onto the recording material P. Lastly, the recording material P with the fixed image is discharged by a discharge roller 81.

In the preceding embodiments, the heating film is directly grounded to prevent an offset in terms of static electricity.

However, the direct connection of the heating film to the frame ground of the image forming apparatus (hereinafter, referred to as FG) brings forth the following problems. First, when external noises are present, coming through the commercial power line directly connected to the image forming apparatus, in particular, when an excessive voltage is imparted between the power line and the FG, this excessive voltage is directly imparted between the heating film and the heater, whereby it is possible for the protective layer coated on the heater surface to be damaged.

Secondly, electrical noises generated by a low voltage power source or the like in the image forming apparatus are transmitted to the heater in the same manner as the noises from the power line, whereby a condenser is formed between the heater and film, and the noises from the heater flow to the FG through this condenser.

Hereinafter, preferred embodiments for solving the problems described above are described.

Embodiment 5

Figure 14:
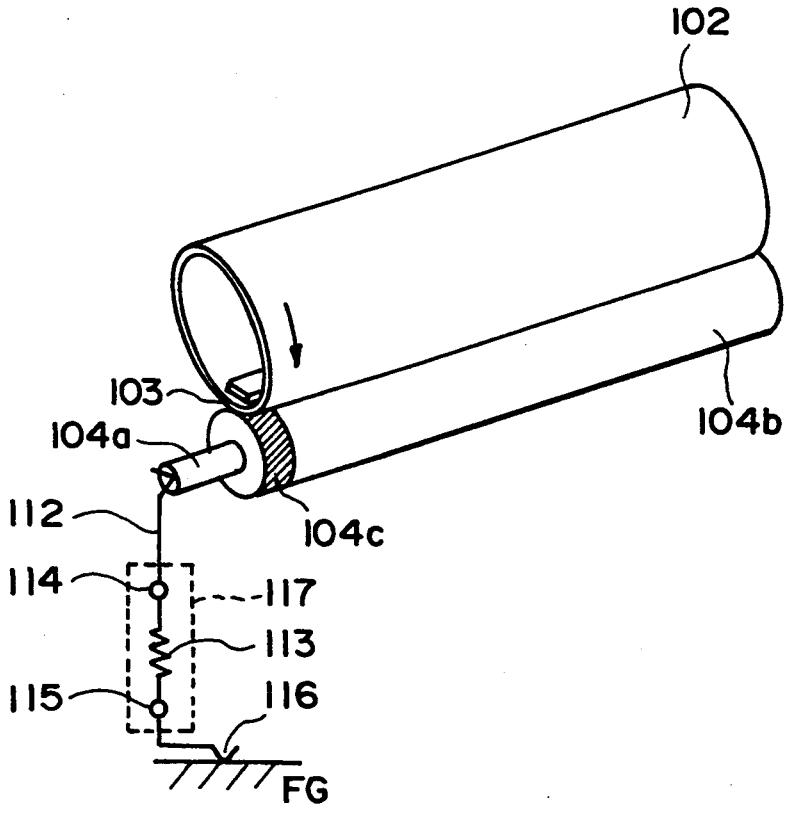
FIG. 14 is a partial perspective view of the fifth embodiment of the present invention.

FIG. 14 is a partial perspective view of the fifth embodiment of an image heating apparatus in accordance with the present invention.

A reference numeral 102 designates a heating film of insulating polyimide resin. Its surface is covered with a surface layer of PTFE containing low resistance material and having parting properties.

In the same drawing, a highly conductive heat resistant member 104*c* is provided at one end of a heat resistant rubber 104*b* of a pressure roller 104, so that the conductive, parting layer of the film 102 and a metallic core 104*a* of the pressure roller 104 are electrically connected. This makes the potential of the surface of the film 102 substantially the same as that of the metallic core 104*a*.

A spring 112 is disposed at one end of the metallic core 104*a*. One end of the spring 112 is pressed on the end of the metallic core 104*a*, and the other is crimped around one of the crimp terminals 114 of a highly resistive member 113. In the same manner, the other end of the highly resistive member 113 is connected to a spring 116 by crimping one end of the spring 16 around a crimp terminal 115 of the highly resistive member 113, and other end of the spring 116 is connected to the FG of the image forming apparatus.

The highly resistive member 113 and springs 115 and 116 disposed at each end thereof are fixed to the fixing apparatus or the image forming apparatus, with the use of a molded member 117.

The highly resistive member 113 incorporated in this embodiment is a thick film resistor having a resistance value of 100 MΩ±20% and a durable or withstand voltage of 5 KV.

This embodiment has the following effects in addition to the effect of preventing the electrostatic offset.

1. The power line noises can be managed.

When an excessive voltage noise, more particularly, a so-called lighting surge having a wave-height of 5 KV, is imparted, the voltage generated between the heater and the power line can be suppressed to no more than 1.6 KV. It is not easy to produce a heater surface protection layer capable of withstanding a voltage as high as 5 KV, but if all that is needed of the protective layer is to withstand 1.6 KV or so, such a protective layer can be realized by simply coating the heater surface with glass as the protective layer, a few times.

Thus, the protective layer can be made thinner, in other words, the quick warmup time is hardly impeded by the presence of the protective layer.

Figure 15:
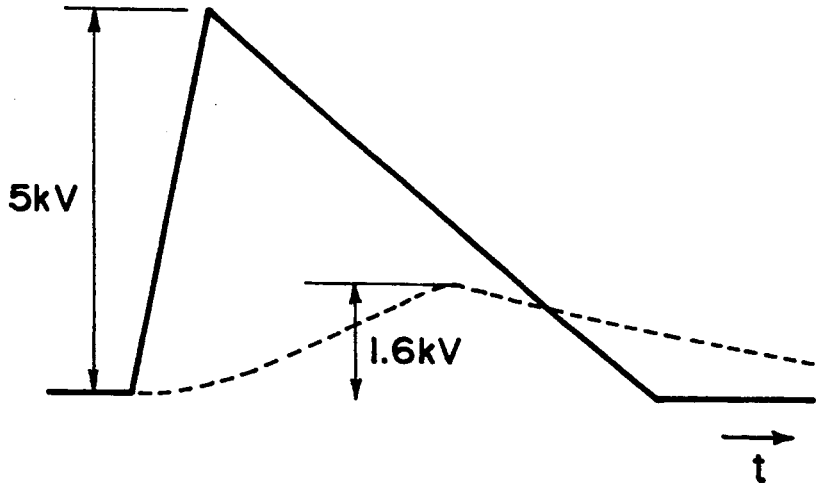
FIG. 15 is a graph showing the attenuation of the noise caused by the excess voltage of a commercial power line.

FIG. 15 shows the waveform of the voltage.

Figure 16:
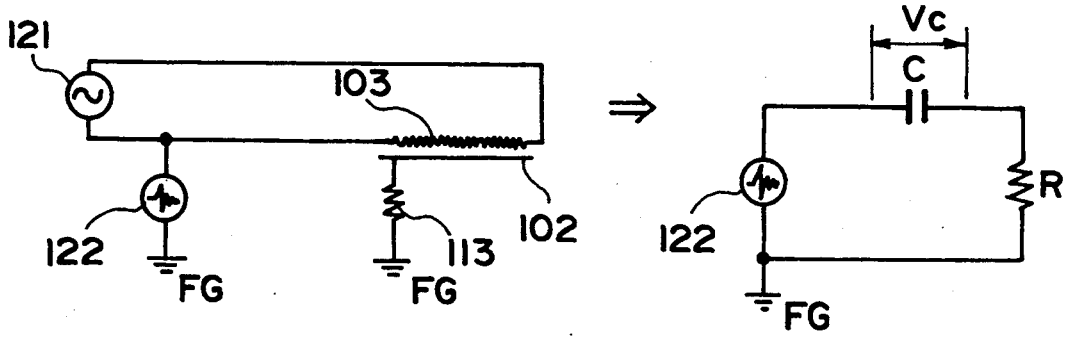
FIG. 16 is an equivalent circuit of the embodiment of the heating apparatus in accordance with the present invention.

FIG. 16 shows the electrical circuit structure of a fixing apparatus in accordance with the present invention. In the drawing, a reference numeral 121 designates a commercial power source and 122 designates the external noise source. The drawing on the right is an equivalent circuit of the structure on the left, wherein R is a high resistance resistor, and C is a capacitor formed between the heater 103 and film 102. It also becomes evident from these drawings that the voltage imparted on the protective surface layer of the heater, that is, the voltage Vc between both ends of the capacitor C, is substantially suppressed compared to the noise voltage.

As a result, the withstand voltage specification value of the protective layer can be lowered, whereby the cost of the ceramic heater can be reduced. In order to raise the level of the dielectric strength of the protective layer, a glass material layer must be repeatedly baked onto the heater surface. Therefore, the number of baking processes to be repeated can be reduced by reducing the dielectric strength, which in turn makes it possible to lower the ceramic heater cost.

2. Terminal noises can be reduced.

As is evident from FIG. 16, the noise from the heater can be suppressed by the provision of the high resistance resistor.

FIGS. 17 to 20 show the results of the terminal noise measurements.

Figure 17:
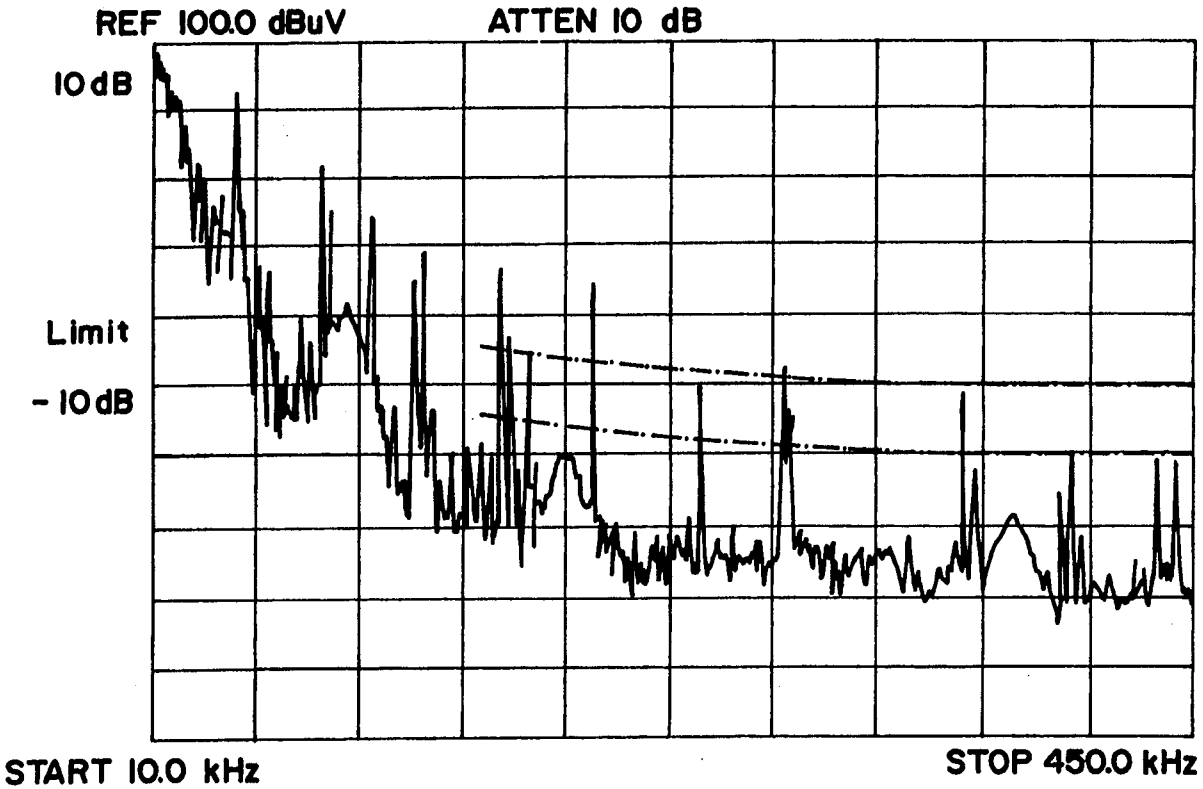
FIG. 17 is a graph showing the noise level in a range of 10 KHz to 450 KHz when the heating film is directly grounded.
Figure 18:
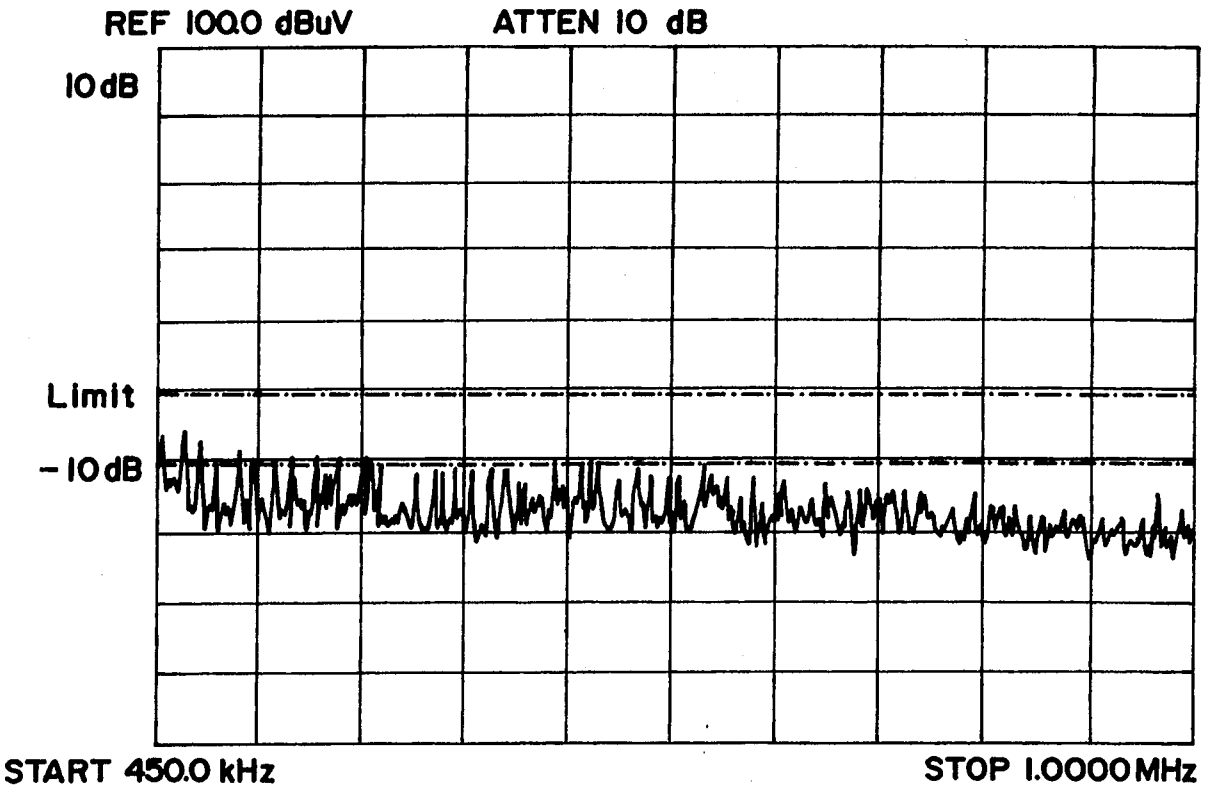
FIG. 18 is a graph showing the noise level in a range of 450 KHz to 1.0 MHz when the heating film is directly grounded.
Figure 19:
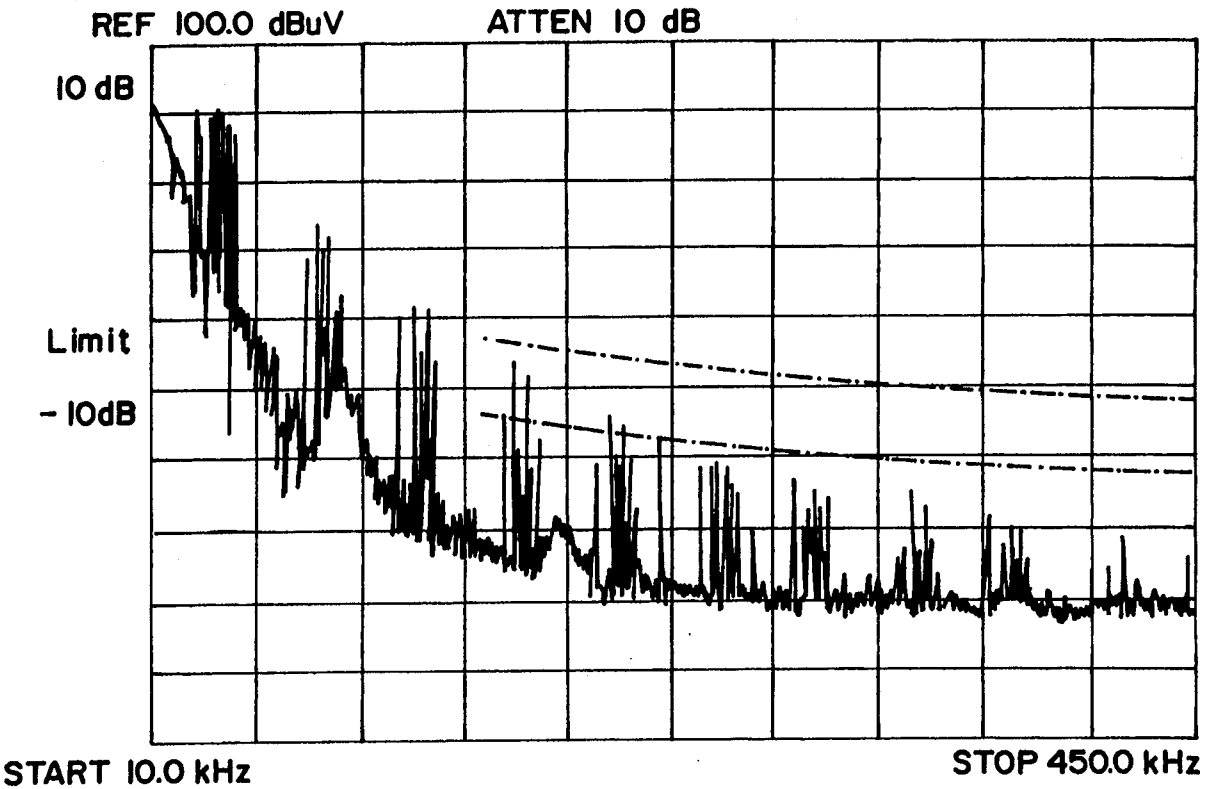
FIG. 19 is a graph showing the noise level of the embodiment of the present invention, in the range of 10 KHz to 450 KHz.
Figure 20:
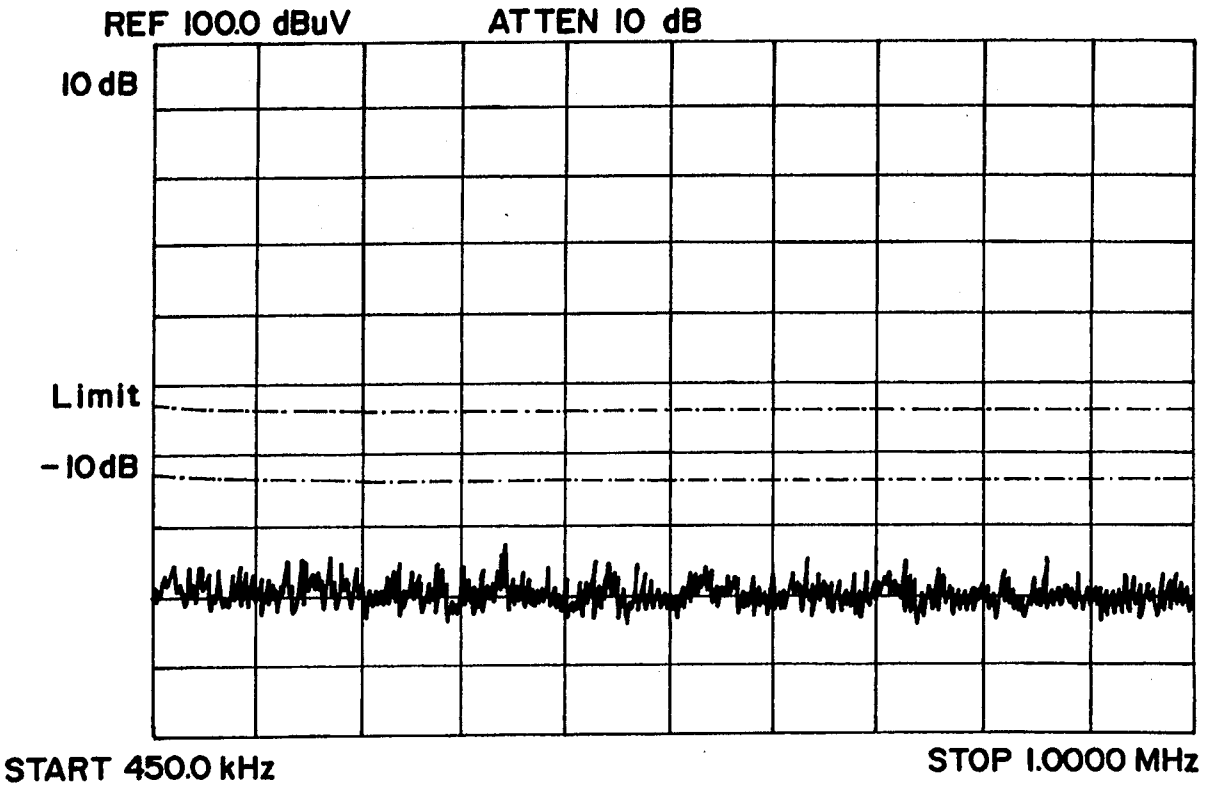
FIG. 20 is a graph showing the noise level of the embodiment of the present invention, in the range of 450 KHz to 1.0 MHz.

FIGS. 17 and 19 represent the data with reference to a frequency range of from 10 KHz to 450 KHz, and FIGS. 18 and 20 represent the data with reference to a frequency range of from 450 KHz to 1.0 MHz.

FIGS. 17 and 18 show the results without the high resistance resistor, and FIGS. 19 and 20 show the results with presence of the high resistance resistor. These data prove that incorporation of the high resistance resistor reduces the noise by approximately 10 dB.

3. The current leaking to the FG can be prevented from increasing.

When the protective layer of the heater is destroyed, it is possible for a current to leak from the commercial power line to the FG. However, the provision of the high resistance resistor between the film and the FG can reduce this leak current to substantially zero, eliminating thereby the danger to operators of the image forming apparatus.

The resistance .value of the resistor connected between the conductive layer of the film 102 and the FG is preferred to be 10 MΩ to 300 MΩ. A value less than 10 MΩ cannot offer a sufficient counter-noise effect.

When the value is higher than 300 MΩ, the current flowing from the recording material to the resistor through the film generates a high voltage, inducing thereby an electric field which attracts the toner, in other words, an electrostatic offset is generated.

While the invention has been described with reference to the structures disclosed therein, it is not confined to the details set forth and the application is intended to cover such modifications or changes as may come within the purposes of the improvements of the scope of the following claims.

What is claimed is:

1. An image heating apparatus comprising:

a heater;

a heat transmitting member for transmitting heat from said heater to an unfixed toner image while moving in contact with a recording material bearing the unfixed image;

a pressure roller for forming a nip between said heat transmitting member and itself;

wherein said heat transmitting member has a conductive surface and said pressure roller has a conductive core member; and wherein said image heating apparatus further comprises a rotating conductive member on the conductive core member in contact with the conductive surface.

2. An image heating apparatus according to claim 1, wherein said conductive member is of rubber containing material having low resistance.

3. An image heating apparatus according to claim 2, wherein the external diameter of said conductive member is substantially the same as that of said pressure roller.

4. An image heating apparatus according to claim 1, wherein the volumetric resistivity of said conductive member is not more than $10^8$ Ω/cm.

5. An image heating apparatus according to claim 1, wherein said conductive member is in contact with said heat transmitting member, outside a passageway of the recording material.

6. An image heating apparatus according to claim 1, wherein said heat transmitting member includes a laminated resin film comprising a base layer of insulating resin and a surface layer having parting properties.

7. An image heating apparatus according to claim 6, wherein said film comprises a conductive primer layer for adhering said base layer of resin and surface layer with parting properties, and said conductive surface is a portion of said conductive primer layer.

8. An image heating apparatus according to claim 1, wherein said apparatus further comprises a driving means for driving said conductive core member, wherein said heat transmitting member is rotated by the rotation of said pressure roller.

9. An image heating apparatus according to claim 1, wherein said conductive core member is grounded.

10. An image heating apparatus according to claim 1, wherein said heater remains stationary, and said heat transmitting member slides on a surface of said heater.

11. An image heating apparatus according to claim 1, wherein said conductive core member is grounded through a resistor.

12. An image heating apparatus according to claim 11, wherein the resistance value of said resistor is in a range of 10 MΩ to 300 MΩ.

* * * * *

UNITED STATES PATENT AND TRADEMARK OFFICE

CERTIFICATE OF CORRECTION

PATENT NO. : 5,404,214
DATED : April 4, 1995
INVENTOR(S) : TOSHIO YOSHIMOTO, ET AL.

It is certified that error appears in the above-indentified patent and that said Letters Patent is hereby corrected as shown below:

Column 3,
line 38, "core 52," should read --core 5a--.
Column 6,
line 54, "core 53" should read --core 5a--.
Column 11,
line 4, "spring 16" should read --spring 116--.
Column 12,
line 10, ".value" should read --value--.

Signed and Sealed this

Twentieth Day of June, 1995

Bruce Lehman

*Attest:*

BRUCE LEHMAN

*Attesting Officer*

*Commissioner of Patents and Trademarks*